US012768614B2

(12) United States Patent
Vanek

(10) Patent No.: US 12,768,614 B2
(45) Date of Patent: Oct. 20, 2026

(54) ADJUSTABLE STOCK SYSTEMS FOR WEAPONS INCLUDING FIREARMS

(71) Applicant: Vantac Technologies LLC, Florence, MT (US)

(72) Inventor: Joede Thomas Vanek, Florence, MT (US)

(73) Assignee: Vantac Technologies LLC, Darby, MT (US)

( * ) Notice: Subject to any disclaimer, the term of this patent is extended or adjusted under 35 U.S.C. 154(b) by 0 days.

(21) Appl. No.: 19/007,515

(22) Filed: Jan. 1, 2025

(65) Prior Publication Data

US 2025/0216172 A1 Jul. 3, 2025

Related U.S. Application Data

(60) Provisional application No. 63/617,028, filed on Jan. 2, 2024.

(51) Int. Cl.
*F41C 23/14* (2006.01)
*F41C 23/04* (2006.01)

(52) U.S. Cl.
CPC ..... *F41C 23/14* (2013.01); *F41C 23/04* (2013.01)

(58) Field of Classification Search
CPC ..... F41C 23/04; F41C 23/14
See application file for complete search history.

(56) References Cited

U.S. PATENT DOCUMENTS

| | | | | |
|---|---|---|---|---|
| 964,419 | A * | 7/1910 | Giusto et al. | F41A 9/05 89/158 |
| 3,795,998 | A * | 3/1974 | Kuhl | F41C 23/06 42/74 |
| 10,788,287 | B2 * | 9/2020 | Parker | F41C 23/04 |
| 11,156,433 | B2 | 10/2021 | Griffith et al. | |
| 11,965,708 | B2 * | 4/2024 | Mebberson | F41C 23/14 |
| 2022/0299293 | A1 * | 9/2022 | Mebberson | F41C 23/14 |
| 2023/0204323 | A1 * | 6/2023 | Ludlow | F41C 23/14 42/73 |
| 2025/0102269 | A1 * | 3/2025 | Vanek | F41C 23/04 |

* cited by examiner

*Primary Examiner* — Michelle Clement
(74) *Attorney, Agent, or Firm* — Troutman Pepper Locke LLP; Gabrielle L. Gelozin

(57) ABSTRACT

In accordance with at least one aspect of this disclosure, an adjustable stock system for weapons and/or other suitable devices incudes an adjustable stock, a mounting box defining an interior cavity and a mounting feature configured to mount the adjustable stock to a device, and a moveable assembly including one or more moveable components configured to move relative to the mounting box. The moveable assembly comprises, at least, a rack and pinion assembly configured to bias a buttpad toward an extended position, and a rack stop configured to hold the rack and pinion assembly in place at a desired position.

20 Claims, 7 Drawing Sheets

ADJUSTABLE STOCK SYSTEMS FOR WEAPONS INCLUDING FIREARMS

CROSS-REFERENCE TO RELATED APPLICATIONS

This application claims priority to and the benefit of U.S. Provisional Patent Application No. 63/617,028, filed Jan. 2, 2024, the entire content of which is incorporated herein by reference.

FIELD

This disclosure relates to adjustable stock systems for weapons, e.g., include PDW systems and folding stocks.

BACKGROUND

Certain weapons (e.g., firearms, airsoft guns, cross-bows, etc.) can have an adjustable stock system. Traditionally, these systems have required a user to remove a hand from a weapon and actuate a movable component. This causes loss of grip, loss of cheek weld, a loss of sight picture, and overall loss of control of the weapon while a hand is removed from the weapon.

Such conventional methods and systems have generally been considered satisfactory for their intended purpose. However, there is still a need in the art for improvements. The present disclosure provides a solution for this need.

SUMMARY

In accordance with at least one aspect of this disclosure, an adjustable stock system for weapons and/or other suitable devices incudes an adjustable stock, a mounting box defining an interior cavity and a mounting feature configured to mount the adjustable stock to a device, and a moveable assembly including one or more moveable components configured to move relative to the mounting box. The moveable assembly comprises, at least, a rack and pinion assembly configured to bias a buttpad toward an extended position, and a rack stop configured to hold the rack and pinion assembly in place at a desired position.

In certain embodiments, the rack and pinion assembly can include a rack configured to be connected, directly or indirectly, to the buttpad, and a gear mounted within the mounting box configured to be meshed with the rack. At least one of the gear or the rack can be biased to actuate the buttpad toward the extended position. The gear can be pinned to the mounting box to rotate relative to the mounting box. In certain embodiments, the gear can be biased to urge the rack to the extended position by a constant force spring mounted within the mounting box.

In certain embodiments, the rack can include rack teeth on at least a gear side of the rack configured to abut and mesh with the gear and the rack stop can include at least one tooth configured to abut and mesh with the rack teeth to hold the rack and pinion assembly in place at the desired position.

In certain embodiments, the rack and pinion assembly can be a first rack and pinion assembly included on a first side of the adjustable stock and a second rack and pinion assembly can be included on a second side of the adjustable stock opposite the first side across a width of the adjustable stock. The second rack and pinion assembly can be the same as or can include the same components as the first rack and pinion assembly. In certain embodiments, the second rack and pinion assembly can include a second rack configured to be connected, directly or indirectly, to the buttpad, a second gear within the mounting box and configured to be meshed with the rack, where at least one of the second gear or the second rack are biased to actuate the buttpad toward the extended position and where the second rack includes rack teeth on at least a gear side of the second rack configured to abut and mesh with the second gear. The second rack and pinion assembly can further include a second rack stop having at least one tooth configured to abut and mesh with the rack teeth of the second rack to hold the second rack and pinion assembly in place at the desired position.

In certain embodiments the first and second rack and pinion assemblies can be configured to move in tandem with one another during adjustment of the adjustable stock, for example, the first and second racks can be parallel with one another. In certain embodiments, e.g., with the adjustable stock system mounted to a device, the first rack can be configured to slide along or within a first a first side of the device and the second rack can be configured to along or within a second side of the device with adjustment of the adjustable stock. In certain embodiments, the coupling portion of the mounting box can include a mounting plate for fixedly mounting the adjustable stock to the device.

In certain embodiments, the adjustable stock system can further include an actuator operatively connected to the rack stop to actuate the first rack stop to move between a first position engaged with the rack and pinion assembly to hold the rack and pinion assembly, and a second position disengaged from the first and/or rack and pinion assembly to allow movement of the rack and pinion assembly, e.g., between the extended position and a retracted position or partially extended position.

In certain embodiments, the actuator can be positioned such that the user can actuate the actuator with a digit without removing the user's hand from the device to which the stock system is mounted. In certain embodiments, the actuator can be an ambidextrous actuator, and can include includes a first actuator portion configured to be disposed on a first side of the device and a second actuator portion configured to be disposed on a second side of the device such that the user can actuate the actuator with a digit on either side of the device and removing the user's hand from the device to which the stock system is mounted, and regardless of a handedness of the intended user. In certain embodiments, the actuator can be mounted to or within the mounting box such that with the actuator is removed from the device when the adjustable stock is removed from the firearm.

In certain embodiments the mounting plate can be configured to be hingedly mounted to the rear end of the device such that the adjustable stock is configured to fold about the hinge between a folded position and an unfolded position. In certain embodiments, the actuator can further include an actuator catch mounted with in the mounting box and configured to transfer actuation force from the actuator to the rack stop. The actuator can be operatively (e.g., indirectly) connected to the actuator catch through the mounting box, such that the first actuator portion and second actuator portion remain in place (next to the trigger guard) with the adjustable stock in both the folded position and in unfolded position, and such the actuator is configured to remain with the mounting box with the adjustable stock removed from the device.

In accordance with at least one aspect of this disclosure, a firearm includes, a trigger assembly, and an adjustable stock system having a mounting box configured to operatively connect the stock system to a rear end of the firearm.

In certain embodiments, the stock system a moveable assembly having one or more moveable components configured to move relative to the mounting box, and a rack and pinion assembly configured to bias a buttpad toward an extended position. In certain embodiments, the rack and pinion assembly can include a gear pinned to the mounting box to rotate relative to the mounting box, a rack configured to be connected, directly or indirectly, to the buttpad and having rack teeth on at least a gear side of the rack configured to abut and mesh with the gear, where at least one of the gear or the rack are biased to actuate the buttpad toward the extended position via at least a constant force spring, and a rack stop having at least one tooth configured to abut and mesh with the rack teeth of the rack to hold the rack and pinion assembly in place at a desired position.

In certain embodiments, the moveable assembly can include a second rack and pinion assembly included on a second side of the adjustable stock opposite the first rack and pinion assembly across a width of the adjustable stock. The second rack and pinion assembly can include a second rack configured to be connected, directly or indirectly, to the buttpad and having rack teeth on at least a gear side of the rack configured to abut and mesh with the second gear, a second gear pinned within the mounting box and configured to be meshed with the rack, where at least one of the second gear or the second rack are biased to actuate the buttpad toward the extended position via at least a second constant force spring, and a second rack stop having at least one tooth configured to abut and mesh with the rack teeth of the second rack to hold the second rack and pinion assembly in place at the desired position.

In certain embodiments, the stock system can further include an actuator operatively connected to the rack stop to actuate the rack stop to move between a first position engaged with the rack and pinion assembly to hold the rack and pinion assembly, and a second position disengaged from the first and/or rack and pinion assembly to allow movement of the rack and pinion assembly between the extended position and a retracted position or partially extended position. In certain embodiments, the actuator can be positioned adjacent the trigger assembly such that the user can actuate the actuator with a digit without removing the user's hand from the firearm to which the stock system is mounted.

In accordance with at least one aspect of this disclosure, a firearm can include a trigger assembly, and an adjustable stock system having a mounting box configured to hingedly mount the adjustable stock system to a rear end of the firearm such that the adjustable stock is configured to fold about the hinge. In certain embodiments, the adjustable stock system comprising, a moveable assembly having one or more moveable components configured to move relative to the mounting box, the one or more moveable components comprising a rail and a biasing member configured to bias a buttpad toward an extended position, an actuator operatively indirectly connected to the moveable assembly configured to allow movement of the rail, an actuator catch mounted with in the mounting box and configured to transfer actuation force from the actuator to the moveable assembly, and an actuator catch pin mounted within the mounting box configured to move between a latched and unlatched position, where in the latched position the adjustable stock is held in the unfolded position and in the unlatched position, the adjustable stock is allowed to fold about the hinge to the folded position. In certain embodiments the actuator can be operatively (e.g., indirectly) connected to the actuator catch through the mounting box, such that the actuator remains in place (e.g., adjacent to the trigger guard) with the adjustable stock in both the folded position and unfolded position, and such the actuator is configured to remain with the mounting box with the adjustable stock removed from the firearm.

In certain embodiments, the actuator can be an ambidextrous actuator including a first actuator portion configured to be disposed on a first side of the trigger assembly and a second actuator portion configured to be disposed on a second side of the trigger assembly such that the user can actuate the actuator with a digit on either side of the firearm and removing the user's hand from the firearm.

BRIEF DESCRIPTION OF THE DRAWINGS

So that those skilled in the art to which the subject disclosure appertains will readily understand how to make and use the devices and methods of the subject disclosure without undue experimentation, other embodiments thereof will be described in detail herein below with reference to certain figures, wherein.

DETAILED DESCRIPTION

Figure 1:
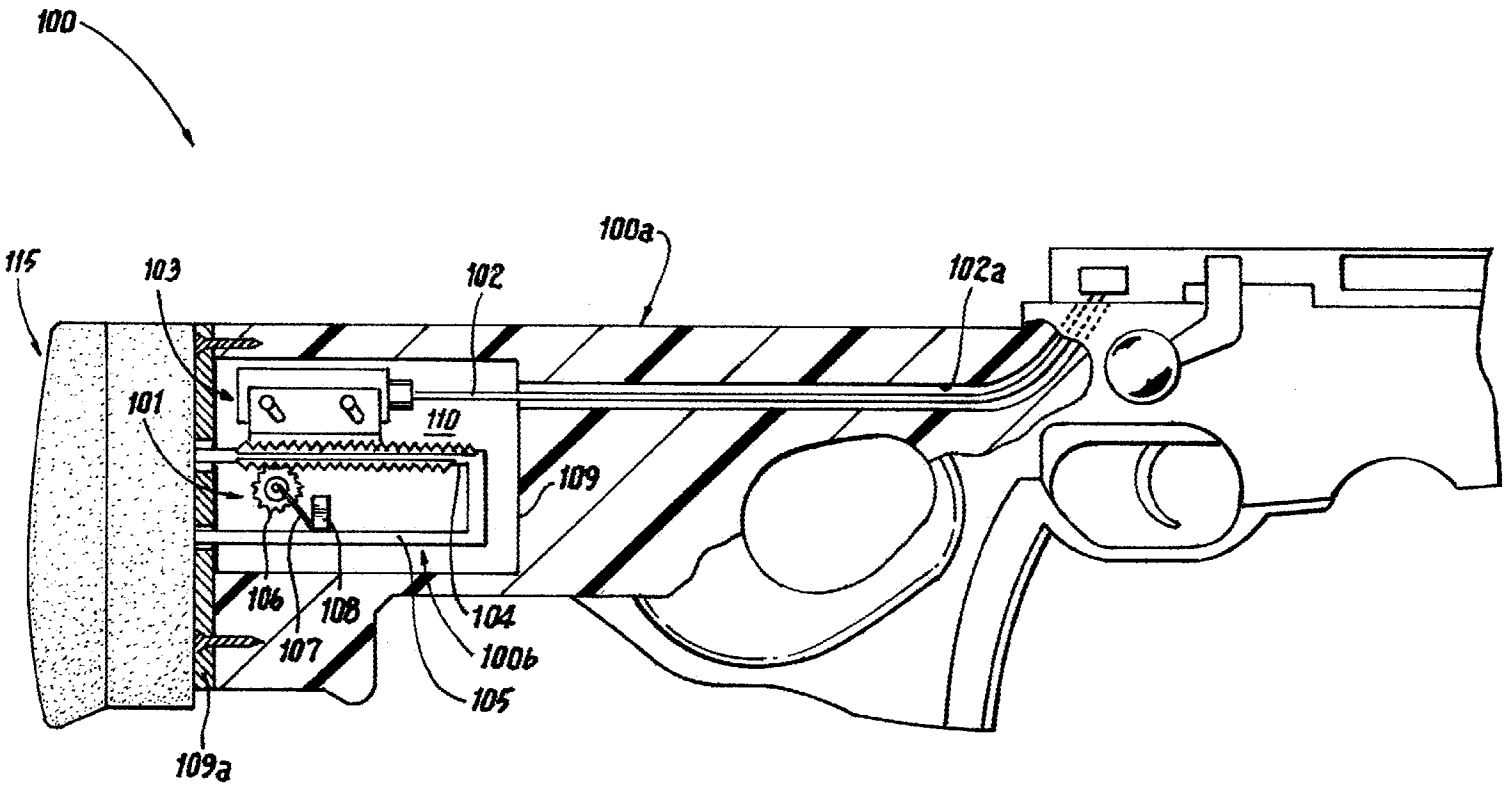
FIG. 1 is a schematic cross-sectional view of an embodiment of a stock system in accordance with this disclosure, shown in a collapsed position and a latched position.

Reference will now be made to the drawings wherein like reference numerals identify similar structural features or aspects of the subject disclosure. For purposes of explanation and illustration, and not limitation, an illustrative view of an embodiment of an adjustable stock system in accordance with the disclosure is shown in FIG. 1 and is designated generally by reference character 100. Other views, embodiments, and/or aspects of this disclosure are illustrated in FIGS. 2-11. Certain embodiments described herein can be used to provide adjustments to a length of the stock of a firearm or other device, without hand removal from a weapon.

Referring to FIG. 1, an embodiment of an adjustable stock system 100 is shown implemented in long rifle, having a fixed stock 100*a* (e.g., a long rifle having a fixed/overhand grip). In certain embodiments, the stock 100*a* can have a curved shape and a rear portion. The stock 100*a* can be made of any suitable number of components (e.g., a single piece, multiple pieces).

The system 100 can include a moveable assembly 100*b* within the stock 100*a* that has one or more moveable components configured to move relative to the stock 100*a*. The movable assembly 100*b* can include an actuator 101 (e.g., a flush mounted slidable or rotatable or pressable or pullable button that can be positioned to be actuated by a thumb of a user without having to move a user's hand off of the weapon or lose sight picture, cheek weld, etc.). The actuator 101 can be connected to a connector member 102 (e.g., a cable, a rod, a series of linkages, etc.) configured to transfer force from the actuator 101. The connector member 102 can be disposed within and/or travel inside a connector member channel 102*a* within the stock 100*a* (e.g., to a cavity defined by a mounting box 109 disclosed below).

The moveable assembly 100*b* can include a lock mechanism 103 connected to the connector member 102 to be actuated by the connector member 102 (e.g., by being pulled). In certain embodiments, the moveable assembly 100*b* can include a toothed adjustment rack 104. In certain embodiments, the moveable assembly 100*b* can include a stabilizing rod 105. As shown, the lock mechanism 103 can include teeth on a bottom configured to engage with teeth on the toothed adjustment rack 104. In certain embodiments, the lock mechanism 103 can be or include one or more embodiments of a latch assembly as shown and/or described in U.S. Pat. No. 10,928,159, incorporated by reference herein in its entirety. In this regard, in certain embodiments, when the connector member 102 moves a first component of the latch assembly, it is cammed by a second component of the latch assembly (e.g., with the teeth) to lift up and/or away from the toothed adjustment rack 104 such that the teeth disengage allowing the toothed.

Figure 2:
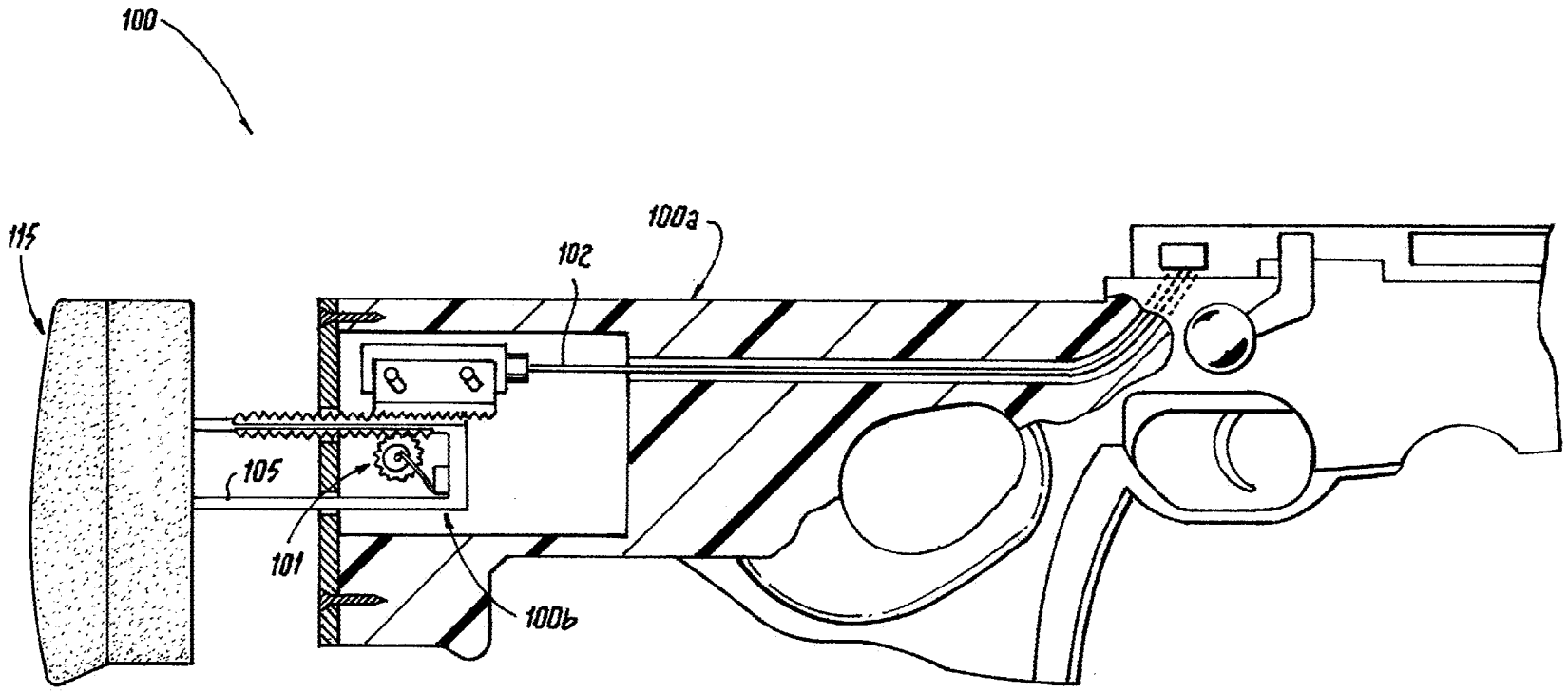
FIG. 2 is a schematic cross-sectional view of the embodiment of FIG. 1, shown in a fully extended position and the latched position latching the rack and buttpad in the fully extended position.

A buttpad 115 can be attached to a toothed adjustment rack 104. In certain embodiments, the buttpad 115 can also be attached to the stabilizing rod 105. The rack 104 and rod 105 can be configured to slide between a collapsed position (e.g., as shown in FIG. 1) and an extended position (as shown in FIG. 2), and the buttpad 115 can move with the rack 104 and the rod 105.

Figure 3A:
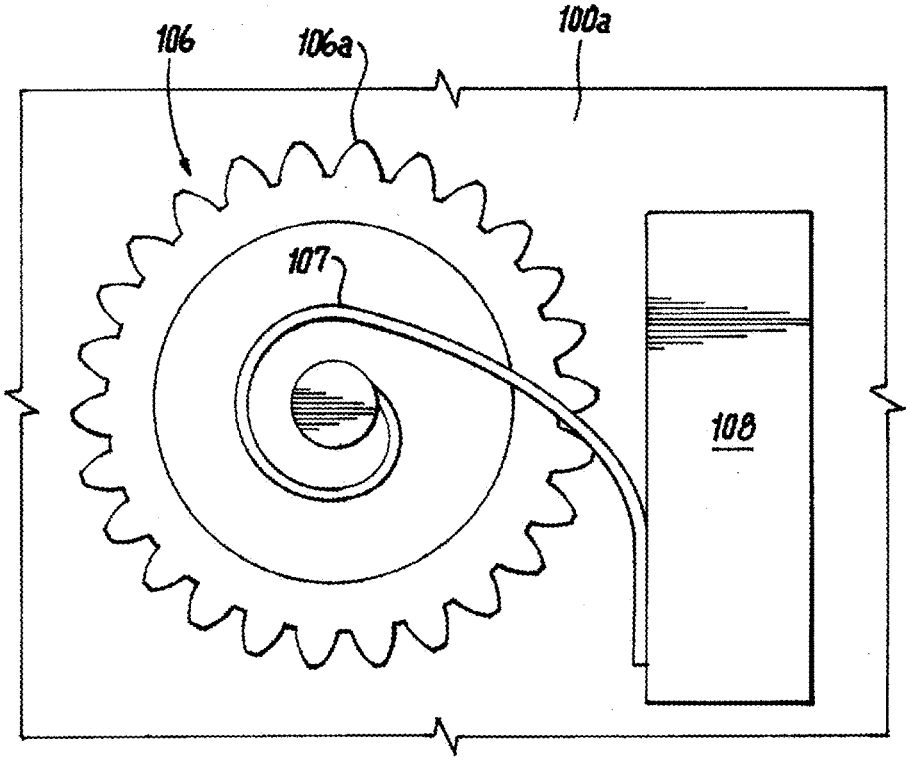
FIG. 3A shows a schematic elevation of an embodiment of a gear of a rack and pinion assembly, shown biased with a constant force spring interfacing with a stopping block.
Figure 3B:
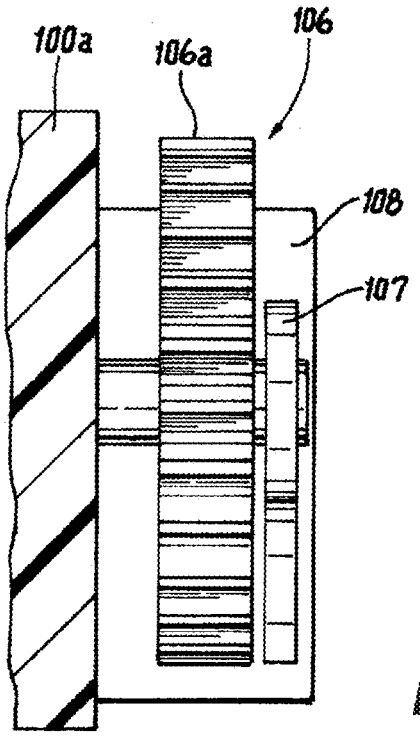
FIG. 3B shows a rear elevation view of the embodiment of FIG. 2A, perpendicular to the view of FIG. 2A.

In certain embodiments, the moveable assembly 100*b* can include a gear 106 pinned relative to the stock 100*a* and configured to rotate to engage with teeth of the toothed adjustment rack 104. The gear 106 can be engaged with a spring 107 (e.g., a spiral spring and/or a constant force spring as shown in FIGS. 3A and 3B) configured to bias the gear 106 in a direction to bias the toothed engagement member 104 toward an extended position. The spring 107 can be mounted to a fixed location (e.g., a plate, the stopping block 108, or any other suitable location such as a spool) at one end, and to the gear 106 at another to rotationally bias the gear 106. Other suitable spring arrangements are contemplated herein. In this regard, the gear 106 can push adjustment rack 104 out of the stock 100*a* when the lock mechanism 103 is in an unengaged position from the toothed adjustment rack 103.

The system 100, the stock 100*a*, and/or the moveable assembly 100*b* can include a stopping block 108 configured to limit motion of the rack 104 or rod 105 (e.g., which can have an L shape or other suitable shape to engage the stopping block 108 when moved to the maximum extended position (e.g., defining a length of pull of about 10 inches to about 15 inches in certain embodiments).

The system 100 can include a mounting box 109. The mounting box 109 can be defined by the stock 100*a* and/or be or include an insertable box or portion thereof. The mounting box 109 can contain one or more components of the moveable assembly 100*b*, e.g., as shown. The system 100 can include a mounting plate 109*a* configured to mount over the mounting box 109 with one or more fasteners 109*b* (e.g., screws) to enclose the mounting box 109*a* and/or fix it to the stock 100*a*. In certain embodiments, the mounting plate 109*a* can include a conforming hole for each of the toothed rack 103 and the rod 104 to slide through, and can thus guide and limit the motion thereof to sliding motion. Any other suitable passageway or transmission through the mounting plate 109*a* is contemplated herein.

In certain embodiments, the moveable components can be entirely contained within the fixed stock 100*a* and can provide easy length of pull adjustment without requiring a user to lose their view through the scope or otherwise take their hands off of the weapon or fingers off of the trigger. A user can actuate the actuator 101 with a thumb of their firing hand, for example, and allow the spring action of the gear 106 to move the buttpad 115 outwardly or apply pressure to the buttpad 115 to push the assembly inward against the force of the spring 107. The actuator 101 can be held while motion is desired, and released when a lock is desired. The teeth in the assembly can be arranged and have any suitable number/size thereof to allow any suitable number of positions of locking. Further discussion of the adjustable stock system 100 is included in U.S. patent application Ser. No. 18/898,101, the entire content of which is incorporated by reference herein.

Figure 4:
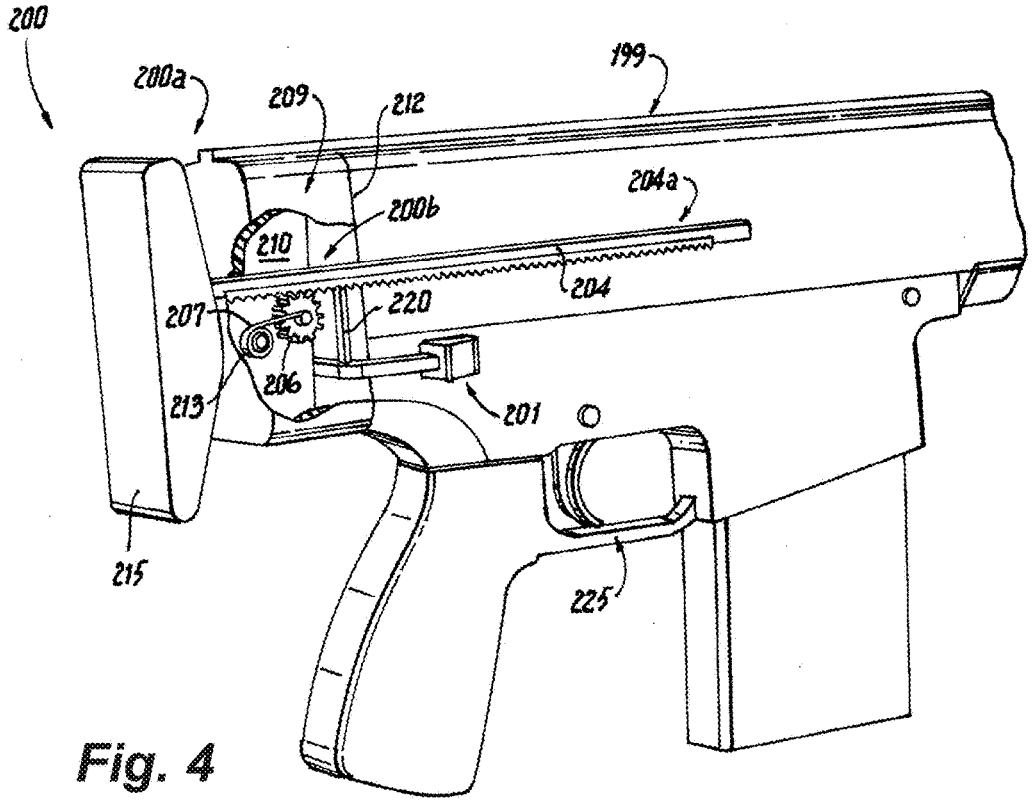
FIG. 4 is a schematic side view of an embodiment of another stock system in accordance with this disclosure, shown in a collapsed position and a latched position.
Figure 5:
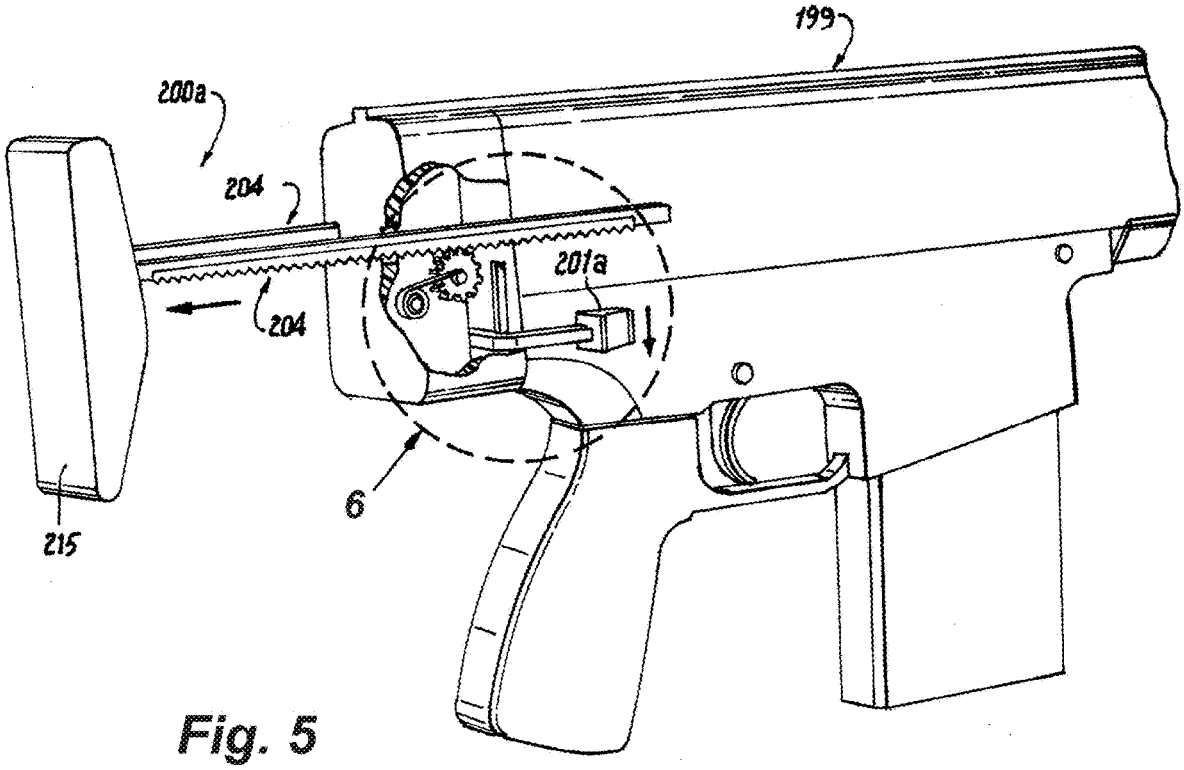
FIG. 5 is a schematic side view of the embodiment of FIG. 4, shown in a fully extended position and the latched position latching the rack and buttpad in the fully extended position.
Figure 6:
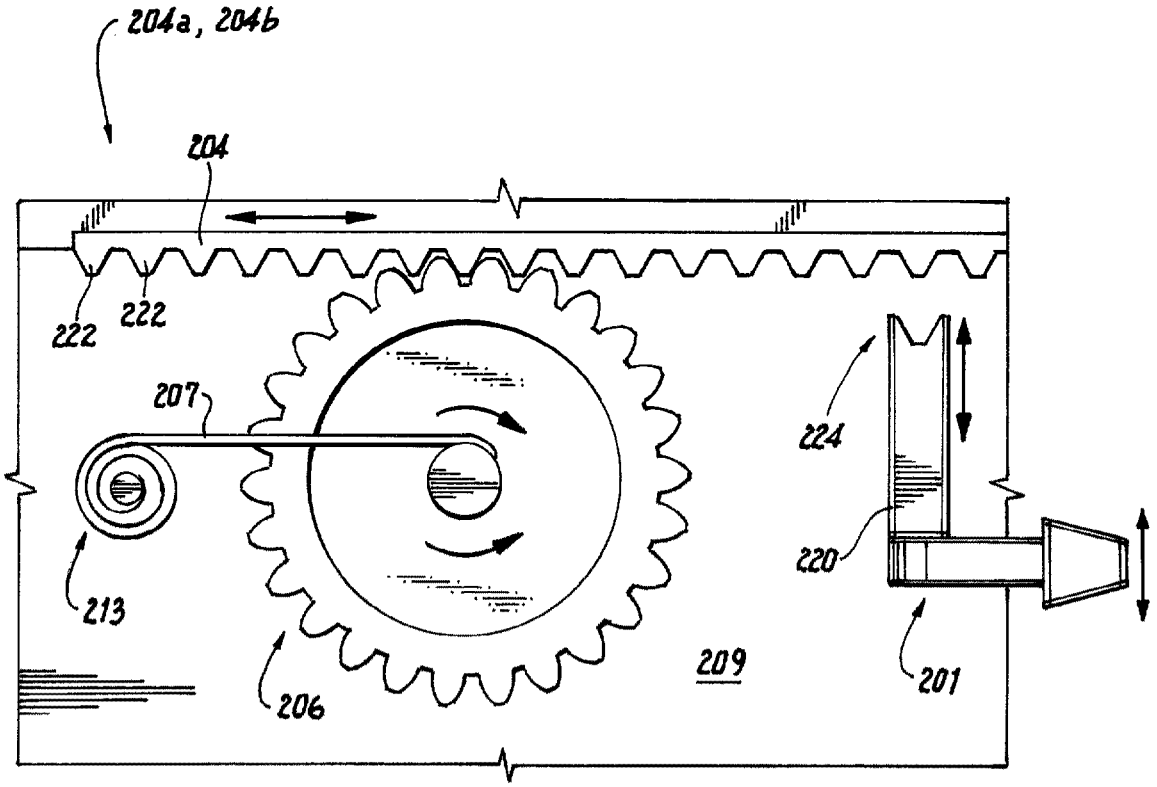
FIG. 6 is an enlarged localized view of a moveable assembly of the stock system shown in FIG. 4.
Figure 7:
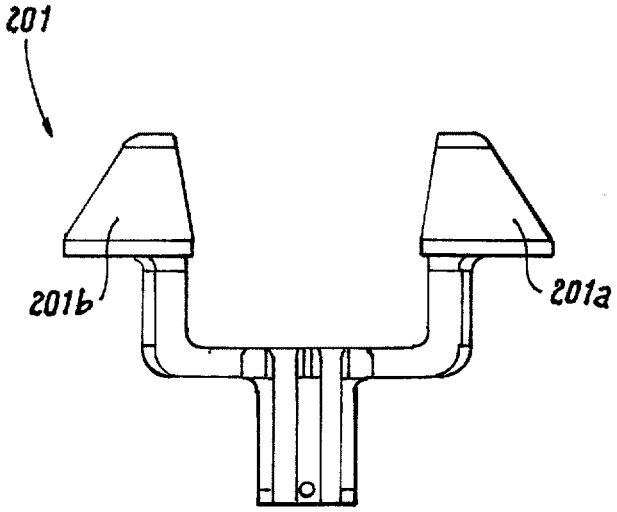
FIG. 7 is a top plan view of an embodiment of an actuator used in the stock system shown in FIG. 4.

Referring now to FIGS. 4-6, in accordance with at least one aspect of this disclosure, another embodiment of an adjustable stock system 200 is shown. The adjustable stock system 200 can be similar to the stock 100 and can have similar components and features with respect to stock system 100. For brevity, the description of common elements that have been described above for stock system 100 will not be repeated with respect to stock system 200 as shown in FIGS. 4-6. As shown in FIG. 4, the mounting box 209 can define an interior cavity 210 housing one or more moveably components of the moveable assembly 200*b*. A mounting feature 212 (e.g., a mounting plate) can be included on one end of the mounting box 209 configured to mount the adjustable stock 200*a* to a device (e.g., a firearm 199). While the device shown and discussed herein is a firearm, the device can include any suitable device. Further, though the drawings may depict limited types of firearms, those having ordinary skill in the art would appreciate, in view of this disclosure, that the adjustable stock system 200 can be mounted to and used with any suitable firearm, such as AR-15s, personal defense weapons, crossbows, or the like.

The moveable assembly 200*b* includes one or more moveable components configured to move relative to the mounting box, including, at least, an assembly (e.g., including rack 204 and gear 206) configured to bias the buttpad 215 toward the extended position (shown in FIG. 5). The moveable assembly 200*b* includes a rack stop 220 configured to hold the rack and pinion assembly in place at a desired position, e.g., anywhere along the rack 204. This is advantageous over conventional adjustable stocks which only provide for adjustment between full retraction and full extension (and not partial extension), or only a small, limited number of defined stops (e.g., between four and six stops). The rack 204 can be connected, directly or indirectly, to the buttpad 215 to move the buttpad 215 with movement of the rack 204.

As shown in the localized view of FIG. 6, the gear 206 is mounted or pinned within the mounting box 209 to rotate relative to the mounting box 209 and to mesh with the rack 204. One of the gear 206 or the rack 204 can be biased to actuate the buttpad 215 toward the extended position, e.g., by a constant force spring 207 mounted on a spool 213 within the mounting box 209. As shown, the rack 204 can include rack teeth 222 on at least a gear side of the rack configured to abut and mesh with the gear 206. The rack stop 220 can also include at least one tooth 224 configured to abut and mesh with the rack teeth 222 to hold the rack and pinion assembly in place, as well as the buttpad 215 at the desired position.

In certain embodiments, the adjustable stock 200*a* can be configured for a personal defense weapon ("PDW"), e.g., as shown in FIGS. 4 and 5. In certain PDW stock systems, the rack and pinion assembly can be a first rack and pinion assembly 204*a* included on a first side of the adjustable stock and a second rack and pinion assembly 204*b* can be included on a second side of the adjustable stock opposite the first side across a width of the adjustable stock 200*a*. This configuration allows the first and second racks 204*a*, 204*b* to travel or slide along or within respective sides of the firearm, when adjusting the stock between the extended and retracted positions. FIG. 4 shows the adjustable stock 200*a* in the retracted position, where the rack 204*b* is shown in phantom as it is obstructed by the firearm. In FIG. 5, the adjustable stock 200*a* is shown in the extended position, where both the first and second racks 204*a*, 204*b* are visible. The second rack and pinion assembly can be the same as or can include the same components as the first rack and pinion assembly. As such, the first and second rack and pinion assemblies can be configured to move in tandem with one another during adjustment of the adjustable stock, for example, the first and second racks are parallel with one another. In certain embodiments, extension stops can be included on the mounting box 209 to prevent the racks 20*a*, 204*b* from releasing out of the rear of the adjustable stock 200*a* in the fully extended position. If desired, the extension stops can be pressed simultaneously to allow the user to remove the racks 204*a*, 204*b*, and buttpad 215 from the assembly, and from the stock 200*a*.

Still with reference to FIGS. 4-6, an actuator 201 is operatively connected to the rack stop 220 to actuate the rack stop 220 to move between a first position engaged with the rack and pinion assembly to hold the rack and pinion assembly (e.g., as shown in FIG. 4), and a second position disengaged from the first and/or rack and pinion assembly to allow movement of the rack and pinion assembly (e.g., as shown in FIG. 5), so that the respective racks can move between the extended position and a retracted position or a partially extended position (anywhere along the rack between the extended and retracted position). In certain embodiments, the actuator can be similarly shaped to that shown and described in U.S. patent application Ser. Nos. 18/109,179 and 18/614,339, both of which are incorporated by reference herein in their entirety. In certain embodiments, the actuator 201 can be configured to bias the rack stop 220 towards the engaged position, such that when the actuator is pressed by the user, the spring 207 urges the racks 204*a*, 204*b* towards the extended position, and releasing the actuator 201 returns the rack stop 220 to the engaged position. With the actuator 201 pressed and the rack stop 220 in the disengaged position, the user can use their shoulder to press the buttstop 215 closer to the firearm 199 to move the buttstop 215 to a partial extended position or to the retracted position.

In certain embodiments, as shown in FIGS. 4 and 5, with the adjustable stock 200*a* mounted to the firearm 199, the actuator 201 can be positioned such that the user can actuate the actuator 201 with a digit without removing the user's hand from the firearm 199 to which the stock system is mounted. In certain embodiments, e.g., as shown in the top plan view of FIG. 7, the actuator 201 can be an ambidextrous actuator, and can include includes a first actuator portion 201*a* configured to be disposed on a first side of the firearm 199 and a second actuator portion 201*b* configured to be disposed on a second side of the firearm 199 such that the user can actuate the actuator 201 with a digit on either side of the device and removing the user's hand from the firearm 199 to which the stock system 200*a* is mounted, and regardless of a handedness of an intended user. In certain embodiments, the actuator 201 can be mounted to or within the mounting box 209 in a manner such removal of the adjustable stock 200*a* from the firearm 199 also removes the actuator 201 with the adjustable stock 200*a*.

The firearm 199 can further include a trigger assembly 225, and the adjustable stock system 200*a* can be mounted to the rear end of the firearm, near the trigger assembly 225, such that the actuator 201 is positioned adjacent (e.g., above, below, forward, or aft of) the trigger assembly 225 so that the user does not need to remove their hand or finger from the trigger/trigger assembly 225 in order to actuate the actuator 201 to adjust the adjustable stock 200*a*.

Figure 8:
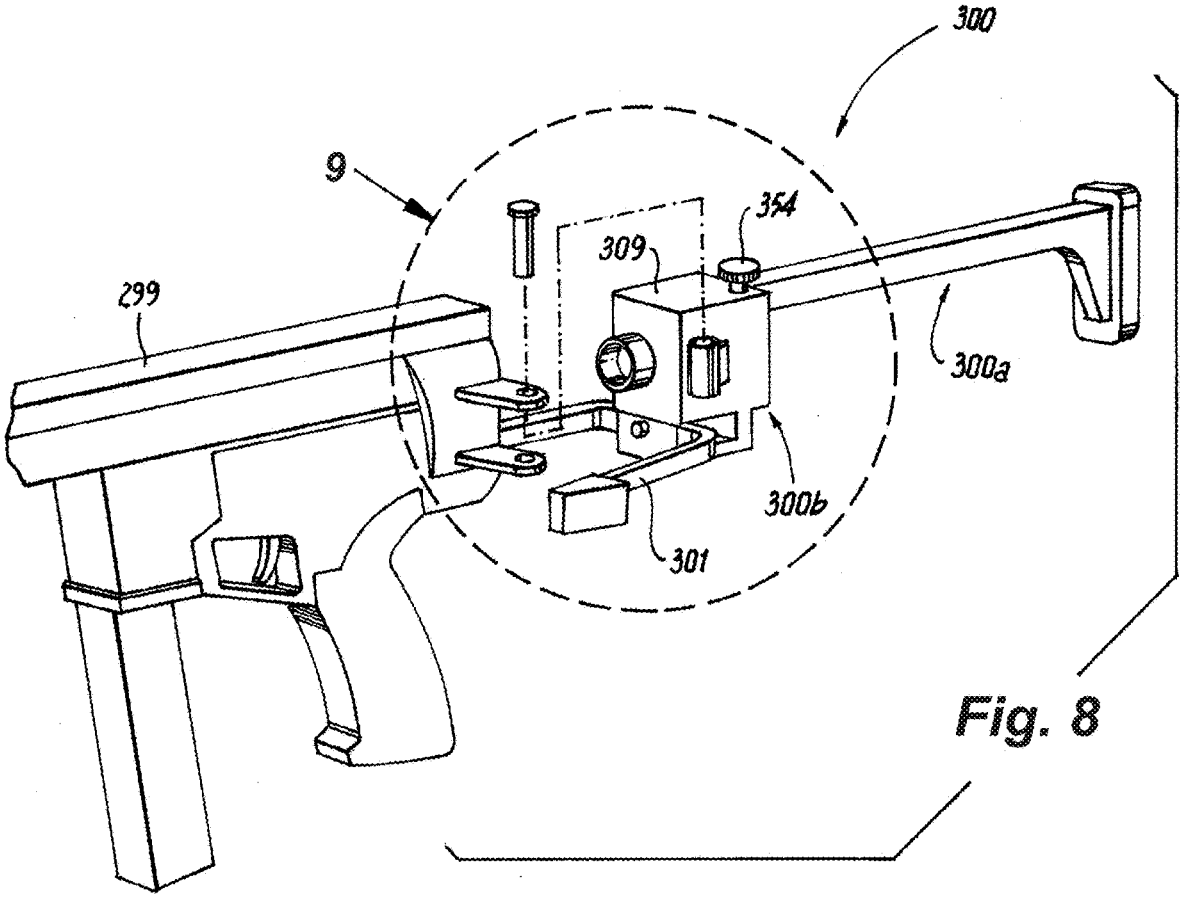
FIG. 8 is a schematic side view of an embodiment of another stock system in accordance with this disclosure, where the stock system is shown detached from a firearm.

With reference now to FIGS. 8-11, in accordance with at least one aspect of this disclosure, another embodiment of a firearm 299 is shown having an adjustable stock system 300 and adjustable stock 300*a* and moveable assembly 300*b*. The firearm 299 and the adjustable stock system 300 can be similar to similar to the stock 200*a* and can have similar components and features with respect to stock system 200. For brevity, the description of common elements that have been described above for stock system 200 will not be repeated with respect to stock system 300 as shown in FIGS. 8-11. FIG. 8 shows adjustable stock system 300 disconnected from the firearm 299.

Figure 9:
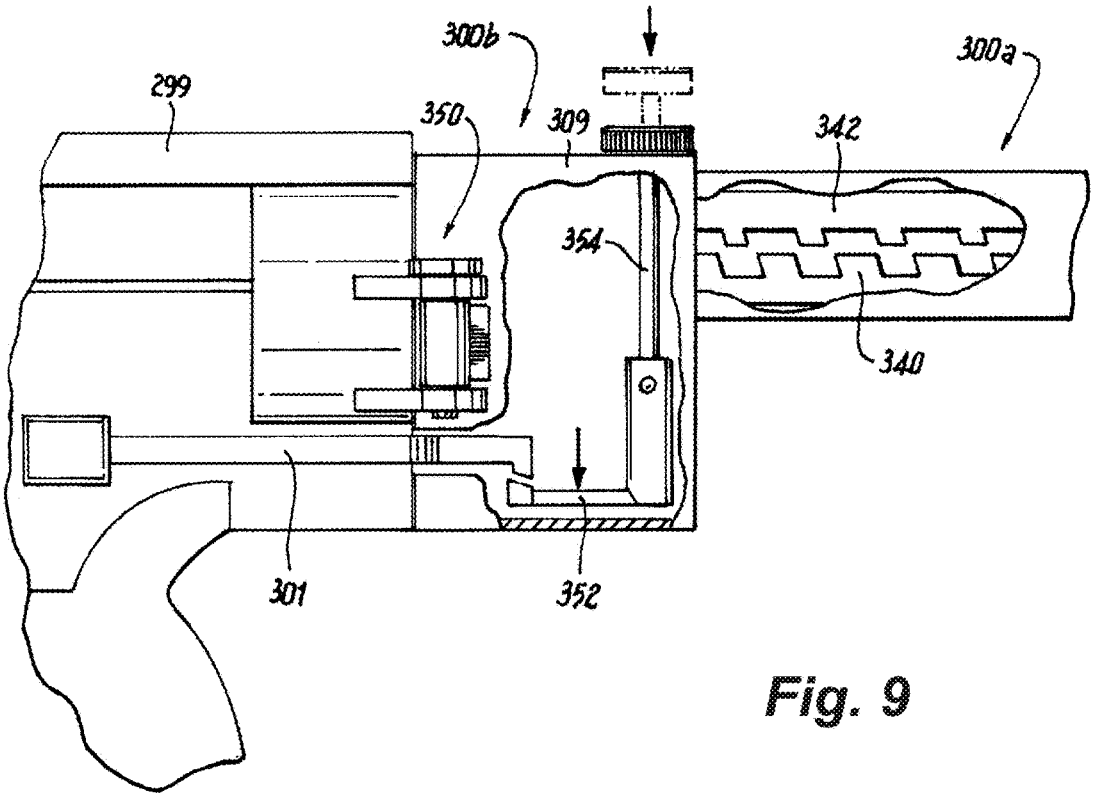
FIG. 9 is an enlarged localized view of a moveable assembly of the stock system shown in FIG. 8.
Figure 10:
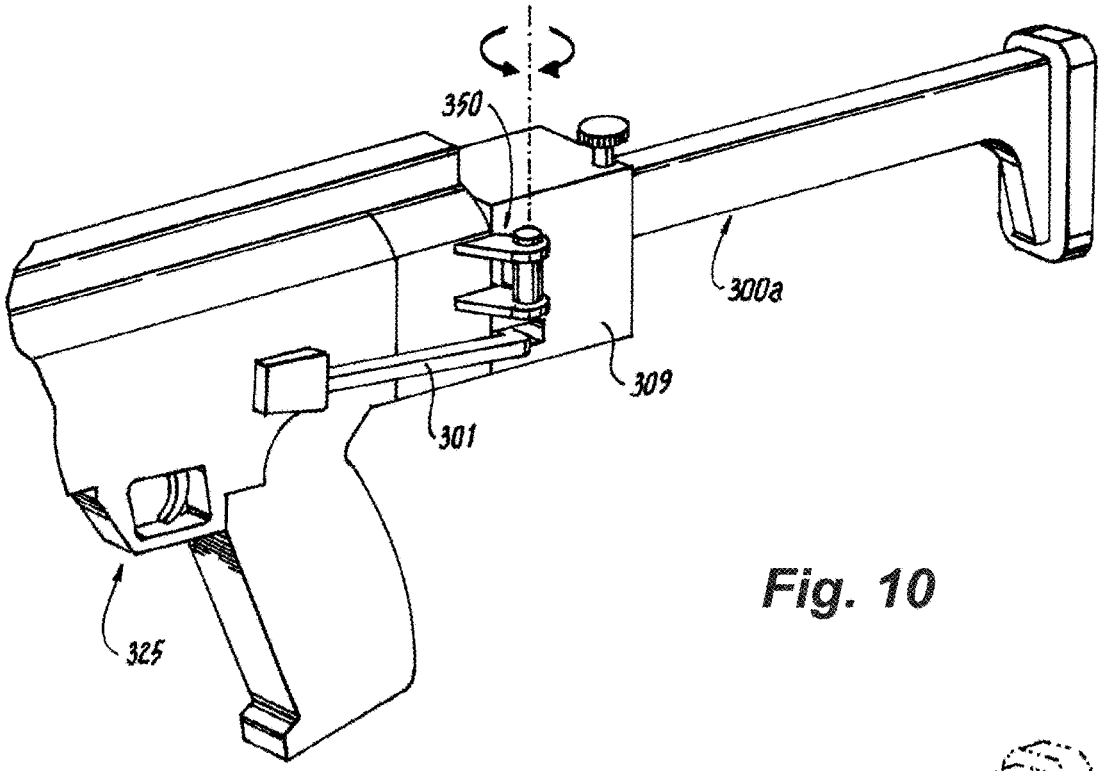
FIG. 10 is a schematic side view of the embodiment the stock system of FIG. 8, where the stock system is shown attached to the firearm and in an unfolded position.
Figure 11:
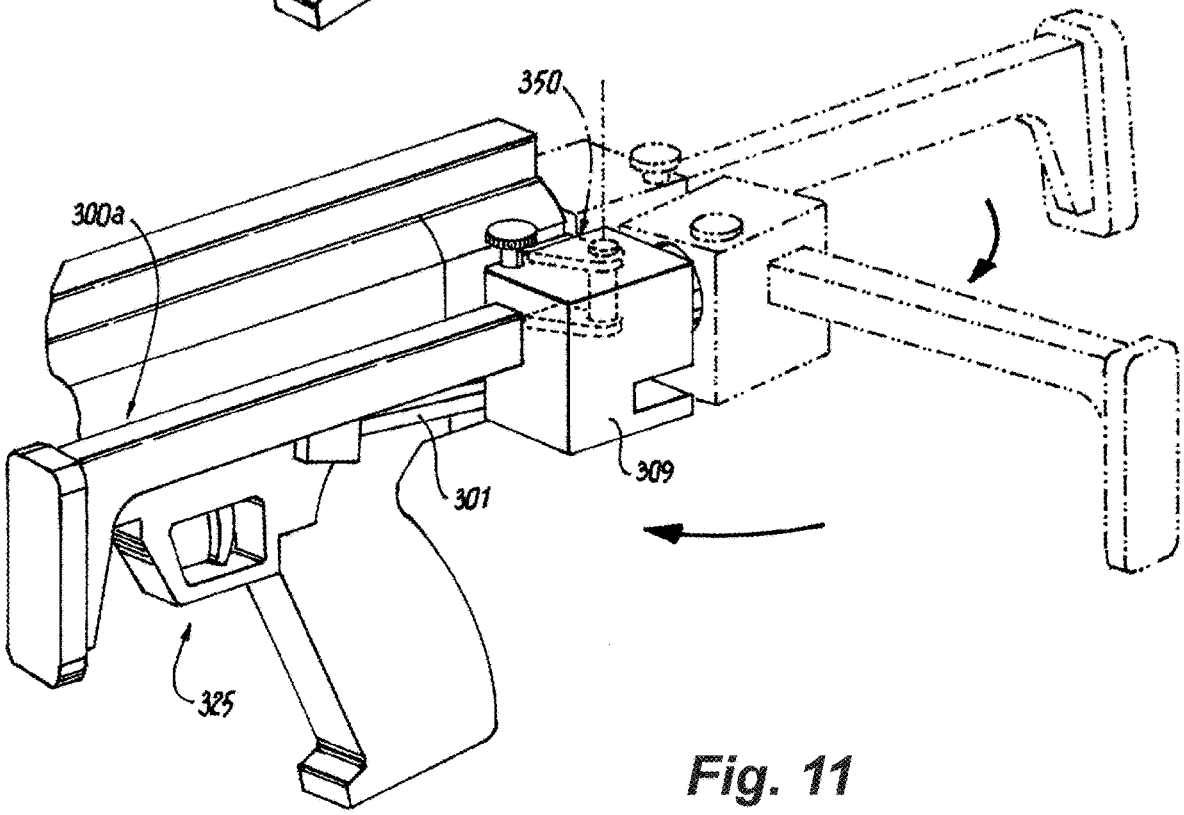
FIG. 11 is a schematic side view of the embodiment the stock system of FIG. 8, where the stock system is shown attached to the firearm and in a folded position.

Referring now to FIGS. 9-11, the adjustable stock system 300 includes a mounting box 309 configured to hingedly mount the adjustable stock system 300 to a rear end of the firearm 299 such that the adjustable stock is configured to fold about the hinge 350, e.g., between a folded and unfolded position as shown in FIGS. 10 (unfolded) and 11 (folded). In certain embodiments, the adjustable stock system can include any embodiment of a moveable assembly as discussed herein (e.g., moveable assembly, 100*b*, 200*b*) or a moveable assembly such as that disclosed in. U.S. Pat. Nos. 10,451,380, 10,928,159, 11,499,794, 11,740,041, 11,965,709 all of which are herein incorporated by reference in its entirety.

In certain embodiments, the moveable assembly can have one or more moveable components configured to move relative to the mounting box 309, such as a rail (e.g., rack 204 or a buffer tube 340 and pull bar 342) and a biasing member (e.g., spring 206 or a compression spring) configured to bias a buttpad toward the extended position. The actuator can be operatively 301 connected to the moveable assembly 300*b* (e.g., indirectly connected) configured to allow movement of the rail with or against the biasing force of the biasing member. Within the mounting box 309, an actuator catch 352 is included and configured to transfer actuation force from the actuator 301 to the moveable assembly 300*b*. The mounting box 309 can also include an actuator catch pin 354 mounted within the mounting box 309 configured to move between a latched and unlatched position. In the latched position, the adjustable stock 300*a* is held locked in the unfolded position, as shown in FIG. 10, so that the moveable assembly is free to adjust the adjustable stock. In the unlatched position, the adjustable stock 300*a* is allowed to fold about the hinge to the folded position, where the mounting box 309 moves with the adjustable stock as it folds to the side of the firearm. The folded position is shown in FIG. 11, where the adjustable stock 300*a* is shown in phantom as it is obscured by the firearm 299. When the stock 300*a* is in the folded position, the actuator 301 and catch 352 can be disconnected so that the actuator 301 does not actuate the moveable assembly 300*b*. When the stock 300*a* is in the unfolded position, the pin 354 locks the adjustable stock 300*a* in place, and engages the actuator catch 352 so that actuator 301 can actuate the moveable assembly 300*b*.

The actuator 301 can be indirectly connected to the actuator catch 352 through the mounting box 309 (e.g., through a window in the mounting box 309), such that the actuator 301 remains in place (e.g., adjacent to the trigger assembly 325) while the adjustable stock 300*a* moves between the folded position and unfolded positions. However, the actuator 301 is operatively connected to the mounting box 309 in a manner such that the actuator 301 is removed from the firearm 299 when the adjustable stock 300*a* is removed from the firearm 299. This can be seen in FIG. 8, where the actuator 301 is included with the adjustable stock 300*a*, before mounting to the firearm 299, and in FIGS. 10 and 11, where the actuator 301 remains in the same location in both the unfolded and folded positions. In certain embodiments, the actuator can be the same or similar to that as described above and shown above with respect to FIG. 7, and as described in U.S. patent application Ser. Nos. 18/109,179 and 18/614,339, the entire contents of which are incorporated by reference herein.

Those having ordinary skill in the art understand that any numerical values disclosed herein can be exact values or can be values within a range. Further, any terms of approximation (e.g., "about", "approximately", "around") used in this disclosure can mean the stated value within a range. For example, in certain embodiments, the range can be within (plus or minus) 20%, or within 10%, or within 5%, or within 2%, or within any other suitable percentage or number as appreciated by those having ordinary skill in the art (e.g., for known tolerance limits or error ranges).

The articles "a", "an", and "the" as used herein and in the appended claims are used herein to refer to one or to more than one (i.e., to at least one) of the grammatical object of the article unless the context clearly indicates otherwise. By way of example, "an element" means one element or more than one element.

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e., "one or the other but not both") when preceded by terms of exclusivity, such as "either," "one of," "only one of," or "exactly one of."

Any suitable combination(s) of any disclosed embodiments and/or any suitable portion(s) thereof are contemplated herein as appreciated by those having ordinary skill in the art in view of this disclosure.

The embodiments of the present disclosure, as described above and shown in the drawings, provide for improvement in the art to which they pertain. While the subject disclosure includes reference to certain embodiments, those skilled in the art will readily appreciate that changes and/or modifications may be made thereto without departing from the spirit and scope of the subject disclosure.

What is claimed is:

1. An adjustable stock system for weapons and/or other suitable devices, comprising:

an adjustable stock;

a mounting box defining an interior cavity and a mounting feature configured to mount the adjustable stock to a device; and a moveable assembly including one or more moveable components configured to move relative to the mounting box, the moveable assembly comprising a rack and pinion assembly configured to bias a buttpad toward an extended position, and a rack stop configured to hold the rack and pinion assembly in place at a desired position.

2. The system of claim 1, wherein the rack and pinion assembly includes:

a rack configured to be connected, directly or indirectly, to the buttpad; and a gear mounted within the mounting box configured to be meshed with the rack, wherein at least one of the gear or the rack are biased to actuate the buttpad toward the extended position.

3. The system of claim 2, wherein the gear is pinned to the mounting box to rotate relative to
the mounting box.

4. The system of claim 3, wherein the gear is biased to urge the rack to the extended position by a constant force spring mounted within the mounting box.

5. The system of claim 4, wherein the rack includes rack teeth on at least a gear side of the rack configured to abut and mesh with the gear.

6. The system of claim 5, wherein the rack stop includes at least one tooth configured to abut and mesh with the rack teeth to hold the rack and pinion assembly in place at the desired position.

7. The system of claim 6, wherein the rack and pinion assembly is a first rack and pinion assembly included on a first side of the adjustable stock, and further comprising:

a second rack and pinion assembly included on a second side of the adjustable stock opposite the first side across a width of the adjustable stock, wherein the second rack and pinion assembly includes:

a second rack configured to be connected, directly or indirectly, to the buttpad;

a second gear within the mounting box and configured to be meshed with the rack, wherein at least one of the second gear or the second rack are biased to actuate the buttpad toward the extended position, wherein the second rack includes rack teeth on at least a gear side of the second rack configured to abut and mesh with the second gear; and a second rack stop having at least one tooth configured to abut and mesh with the rack teeth of the second rack to hold the second rack and pinion assembly in place at the desired position.

8. The system of claim 7, wherein the first and second rack and pinion assemblies move in tandem with one another during adjustment of the adjustable stock.

9. The system of claim 8, wherein the first rack is configured to slide along an outside of a first side of the device and wherein the second rack is configured to slide along an outside of a second side of the device with adjustment of the adjustable stock.

10. The system of claim 7, wherein the coupling portion of the mounting box includes a mounting plate for removably mounting the adjustable stock to the device.

11. The system of claim 1, further comprising:

an actuator operatively connected to the rack stop to actuate the first rack stop to move between a first position engaged with the rack and pinion assembly to hold the rack and pinion assembly, and a second position disengaged from the first and/or rack and pinion assembly to allow movement of the rack and pinion assembly.

12. The system of claim 11, wherein the actuator is positioned such that the user can actuate the actuator with a digit without removing the user's hand from the device to which the stock system is mounted.

13. The system of claim 12, wherein the actuator includes a first actuator portion configured to be disposed on a first side of the device and a second actuator portion configured to be disposed on a second side of the device such that the user can actuate the actuator with a digit on either side of the device and removing the user's hand from the device to which the stock system is mounted.

14. A firearm, comprising:

a trigger assembly; and a adjustable stock system having a mounting box configured to operatively connect the stock system to a rear end of the firearm, the stock system comprising:

a moveable assembly including one or more moveable components configured to move relative to the mounting box, the moveable assembly comprising a rack and pinion assembly configured to bias a buttpad toward an extended position, wherein the rack and pinion assembly includes:

a gear pinned to the mounting box to rotate relative to the mounting box;

a rack configured to be connected, directly or indirectly, to the buttpad and having rack teeth on at least a gear side of the rack configured to abut and mesh with the gear, wherein at least one of the gear or the rack are biased to actuate the buttpad toward the extended position via at least a constant force spring; and a rack stop having at least one tooth configured to abut and mesh with the rack teeth of the rack to hold the rack and pinion assembly in place at a desired position.

15. The firearm of claim 14, wherein the rack and pinion assembly is a first rack and pinion assembly included on a first side of the adjustable stock, and further comprising:

a second rack and pinion assembly included on a second side of the adjustable stock opposite the first side across a width of the adjustable stock, wherein the second rack and pinion assembly includes:

a second rack configured to be connected, directly or indirectly, to the buttpad and having rack teeth on at least a gear side of the rack configured to abut and mesh with the second gear;

a second gear pinned within the mounting box and configured to be meshed with the rack, wherein at least one of the second gear or the second rack are biased to actuate the buttpad toward the extended position via at least a second constant force spring; and a second rack stop having at least one tooth configured to abut and mesh with the rack teeth of the second rack to hold the second rack and pinion assembly in place at the desired position.

16. The firearm of claim 14, further comprising:

an actuator operatively connected to the rack stop to actuate the rack stop to move between a first position engaged with the rack and pinion assembly to hold the rack and pinion assembly, and a second position disengaged from the first and/or rack and pinion assembly to allow movement of the rack and pinion assembly.

17. The system of claim 16, wherein the actuator is positioned adjacent the trigger assembly such that the user can actuate the actuator with a digit without removing the user's hand from the device to which the stock system is mounted.

18. The system of claim 11, wherein the actuator is mounted to or within the mounting box such that removal of the adjustable stock from the firearm also removes the actuator with the adjustable stock.

19. An adjustable stock system for a weapon, comprising:

an adjustable stock;

a mounting box defining an interior cavity and a mounting feature configured to mount the adjustable stock to a device;

a moveable assembly including one or more moveable components configured to move relative to the mounting box, the moveable assembly comprising a rack and pinion assembly configured to bias a buttpad toward an extended position, and a rack stop configured to hold the rack and pinion assembly in place at a desired position; and an actuator operatively connected to the rack stop to actuate the rack stop to move between a first position engaged with the rack and pinion assembly to hold the rack and pinion assembly, and a second position disengaged from the first and/or rack and pinion assembly to allow movement of the rack and pinion assembly, wherein the actuator includes a first actuator portion configured to be disposed on a first side of the weapon and a second actuator portion configured to be disposed on a second side of the weapon such that the user can actuate the actuator with a digit on either side of the weapon and without removing the user's hand from the weapon.

20. The system of claim 19, wherein the adjustable stock is configured to provide a length of pull of about 10 inches to about 15 inches in a maximum extended position, and wherein the rack includes gear teeth along an entire length of the rack.

* * * * *